United States Patent [19]

Stone

[11] 4,100,976

[45] Jul. 18, 1978

[54] PNEUMATIC IMPACT DRILLING TOOL

[75] Inventor: Charles W. Stone, Garden City, Mich.

[73] Assignee: Reed Tool Co., Houston, Tex.

[21] Appl. No.: 748,011

[22] Filed: Dec. 6, 1976

[51] Int. Cl.[2] ..... B25D 9/00

[52] U.S. Cl. ..... 173/133; 60/411; 173/136

[58] Field of Search ..... 173/71, 73, 80, 17, 173/132, 133, 135, 136, 137; 91/234; 60/397, 411

[56] References Cited

U.S. PATENT DOCUMENTS

| | | | |
|---|---|---|---|
| 1,253,290 | 1/1918 | Smith | 173/71 X |
| 2,887,989 | 5/1959 | Dulaney | 173/78 X |
| 3,105,559 | 10/1963 | Collier et al. | 173/73 X |
| 3,527,239 | 9/1970 | Boom | 173/137 X |
| 3,583,501 | 6/1971 | Aalund | 173/80 X |
| 3,599,730 | 8/1971 | Luthman et al. | 173/137 X |
| 3,612,191 | 10/1971 | Martini | 173/73 |
| 3,924,690 | 12/1975 | Shaw | 173/80 X |
| 3,964,551 | 6/1976 | Bassinger | 173/73 |
| 4,015,670 | 4/1977 | Rear | 173/73 X |
| 4,054,180 | 10/1977 | Bassinger | 173/80 X |

*Primary Examiner*—Lawrence J. Staab
*Attorney, Agent, or Firm*—Neal J. Mosely

[57] ABSTRACT

A pneumatically operated impact drilling tool for earth drilling, includes a reciprocating hammer, an anvil positioned under the hammer and a feeder tube extending through the hammer and at least partially through the anvil. The drilling tool is connected to a string of drilling pipe and high pressure compressed air or other pneumatic fluid is introduced to operate the tool. The feeder directs the flow of fluid through ports in the hammer to alternate pressure on opposite sides of the hammer to move the same upward and downward relative to the anvil. A venturi arrangement in the feeder tube functions to produce a vacuum which is applied to the opposite end of the hammer from the end at which pressure is being applied for moving the same.

10 Claims, 5 Drawing Figures

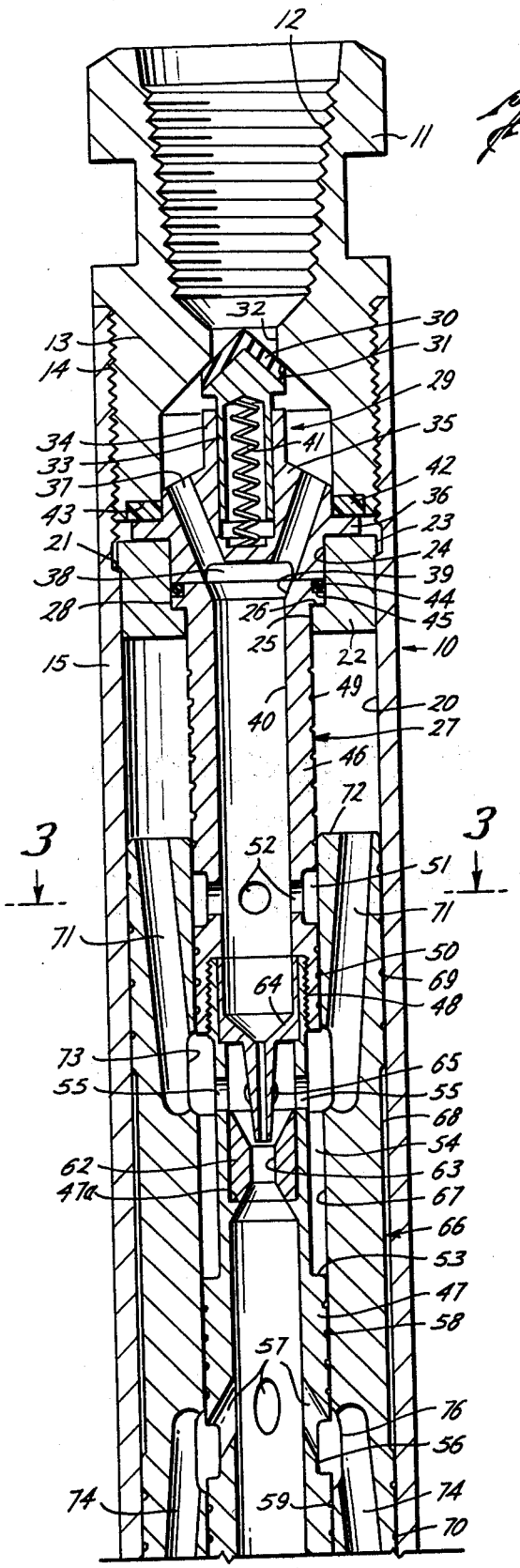
Fig. 1A
Fig. 1B
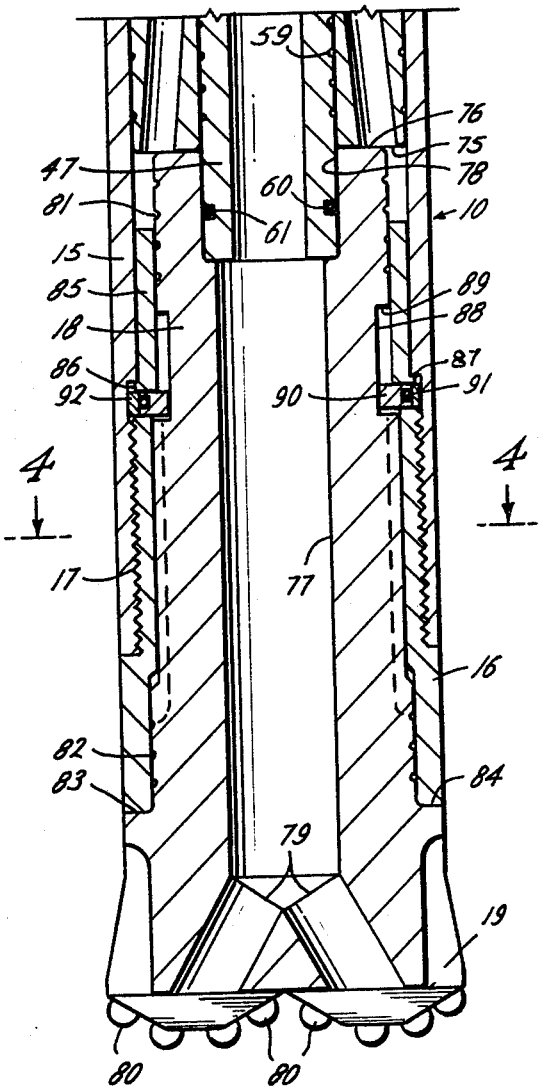

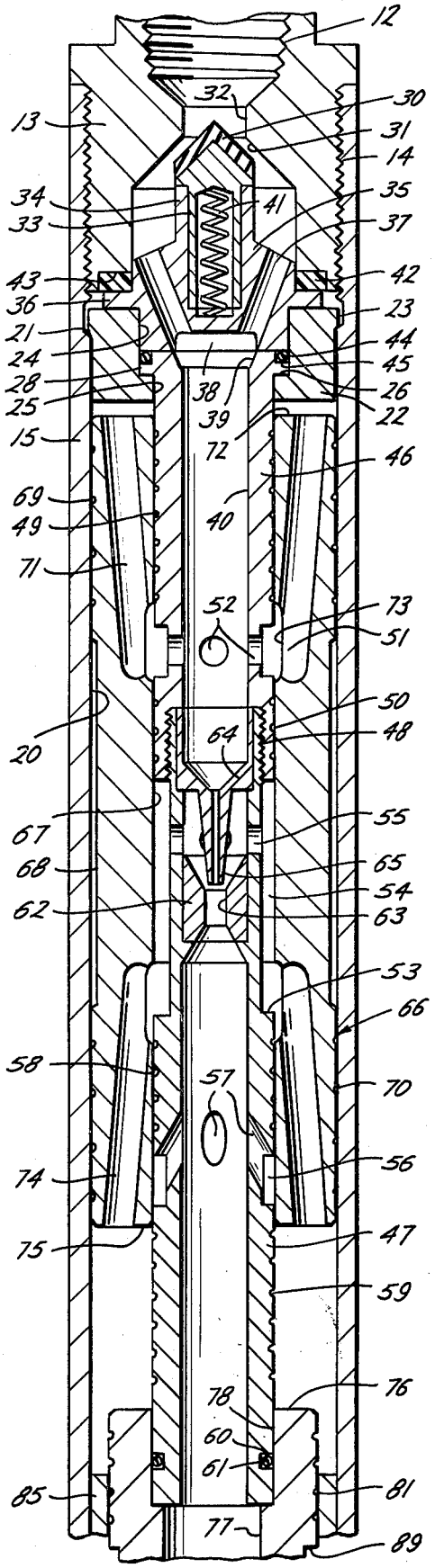
Fig. 2
Fig. 3
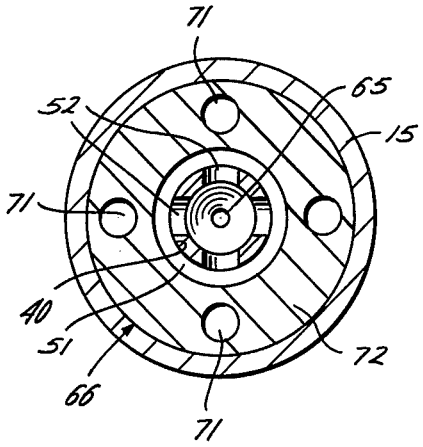
Fig. 4
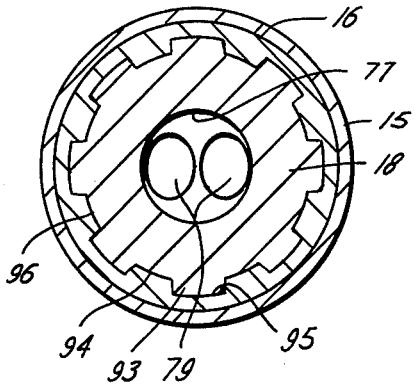

PNEUMATIC IMPACT DRILLING TOOL

BACKGROUND OF THE INVENTION

1. Field of the Invention

This invention relates to impact drilling tools and more particularly to pneumatically actuated impact drilling tools for earth drilling. The tool utilizes a reciprocally movable hammer which strikes an anvil to create an impact force on the drill bit.

2. Description of the Prior Art

Prior to the development of the present invention there have been numerous types of pneumatically operated impact drilling tools. Bassinger U.S. Pat. No. 3,616,868 discloses an earlier form of pneumatic fluid actuated impact tool. Another form of pneumatically operated impact tool is shown in Bassinger U.S. Pat. No. 3,826,316. There are many types of pneumatically operated devices which have been suggested to provide a repeated impact on a drill bit. Normally, the drill bit is attached to or a part of an anvil that is hit by a reciprocating hammer.

In a pneumatically operated reciprocating hammer there are several valve functions which must be performed. A check valve is required to prevent back flow of air within the drilling tool which might draw cuttings within the moving parts of the tool. A valve function should also be provided to cause compressed air to exert force on the lower end of the hammer to raise the same relative to the anvil. Other valve functions are required to exhaust the pressurized air which raises the hammer and to supply compressed air to the upper end of the hammer to drive the same against the anvil. On each reversal of movement of the hammer the pressurized air on the opposite end must be exhausted before the hammer is moved.

In pneumatically operated rotary drilling tools, the drill rate of a standard drill bit using standard air pressure becomes the key to the success of the percussion tool. However, increased drilling rate cannot be accomplished at the expense of destroying the drill bit. It has been found in the past that a standard hold down force can be applied to rotary drill bits with an impact force being superimposed thereon to greatly increase the rate of drilling. It has also been found that if the impact force is increased and the hold down force decreased the drill rate can be increased without damage to the drilling equipment. Since the pressure of the pneumatic fluid is normally fixed, the downward impact of the hammer is dependent upon the upper surface area subjected to the pneumatic pressure, the stroke length of the hammer and the time required for pressurization and exhaust.

A typical pneumatically operated impact drilling tool sold commercially is illustrated in U.S. Pat. No. 3,503,459. The drilling tool shown in this patent has certain limitations including weak structural walls of the casing, expensive to manufacture, smaller surface area in the hammer and slow pressurization and exhaust. Any undercut or passage through the casing of an impact drilling tool seriously weakens the lateral strength of the tool, especially for small diameter tools. The pneumatic tool of the aforementioned patent is particularly weak in the outer casing which makes it subject to damage during operation.

Various types of percussion drilling devices have been designed and patented where the entire upper diameter of the hammer is acted upon by the pressurized fluid to drive the hammer downward against the anvil. However, to perform the necessary valving functions each of these devices requires undercuts in the casing with cross bores, slots, undercuts and/or vertical feeds being necessary within the hammer element itself. To insure against structural damage of the hammer element, each of these bores, cross slots, undercuts, etc., must end in a rounded surface. All of these problems result in decreased strength of the hammer, increased expense of manufacture and decreased lateral strength of the drilling tool.

In Bassinger U.S. Pat. No. 3,964,551, there is shown a pneumatically operated percussion type rotary drilling tool having a hammer element which reciprocates along the axis of the drilling tool to strike an anvil which is integral with a bit. The hammer is repeatedly raised and driven downward by pneumatic fluid and valving functions are controlled from the center of the hammer element. No undercuts or feeds extend through the casing. The pressurization and exhaust times are minimum. That pneumatic impact tool, however, is somewhat more complex than is desirable, particularly in the design of the feeder tube and the necessity for special cooperative tubing and valving for exhausting compressed air from the tool.

SUMMARY OF THE INVENTION

This invention relates to a new and improved pneumatically actuated impact tool for rotary drilling. The hammer element reciprocates along the axis of the drilling tool to strike an anvil repeatedly which has a bit integral therewith. The hammer is repeatedly raised and driven downward by the pneumatic fluid that is normally supplied to the drill bit through the drilling pipe. All valving functions are controlled from the center of the hammer element thereby allowing a maximum surface area against which the pressurized pneumatic fluid acts in driving the hammer against the anvil. The structure is further simplified in that a single feeder tube extends through the hammer and into the anvil-bit member so that the pneumatic fluid is continuously blown through the tool while alternately being applied to the hammer for reciprocation thereof. The tool is provided with a means for producing a low pressure or vacuum which is applied to the end of the hammer opposite the end to which pressurized pneumatic fluid is applied for movement of the hammer. This application of vacuum is alternated with the alternation of application of pressure to one end of the hammer or the other.

BRIEF DESCRIPTION OF THE DRAWINGS

FIG. 1A and FIG. 1B are sectional views taken along the longitudinal axis of a pneumatic tool constructed in accordance with this invention.

FIG. 2 is a sectional view of the tool as shown in FIGS. 1A and 1B with the hammer piston moved to the top of its stroke.

FIG. 3 is a sectional view of FIG. 1A taken along the line 3—3.

FIG. 4 is a sectional view of FIG. 1B taken along the line 4—4 thereof.

DESCRIPTION OF THE PREFERRED EMBODIMENT

Referring to the drawings by numerals of reference and more particularly to FIGS. 1A and 1B in combination there is shown a longitudinal cross sectional view of the present invention wherein the reference numeral 10 represents the pneumatic impact drilling tool. FIGS.

1A and 1B represent the tool cut into two pieces with the upper portion of FIG. 1B being a continuation of the lower end of FIG. 1A. This pneumatic drilling tool is designed for connection in a string of drilling pipe immediately above a drill bit. The pneumatic tool 10 has an upper sub 11 which is internally threaded as at 12 for connection to a string of drill pipe (not shown). The lower end portion 13 of sub 11 is threadedly connected as indicated at 14 to the open upper end of casing 15 of the tool 10. The internal portion of casing 15 which incorporates the present invention will be described in more detail subsequently. The bottom end of casing 15 is connected to a driver sub 16 by threaded connection 17. Anvil member 18 is slidably positioned in sub 16 and is formed integrally with drill bit 19.

Casing 15 has a smooth inner bore 20 for guiding the hammer piston as will be subsequently described. The upper end of the casing bore 20 is enlarged and threaded as shown at 14 and has a very slight shoulder 21 at the base of the threads. A cylindrical retaining plug 22 is positioned in the upper end of casing bore 20 and has a very slight shoulder 23 which engages shoulder 21 and limits movement of the retaining plug 22 in the casing bore. The plug 22 is very closely fitted in place and is held firmly in position to resist movement. Plug 22 has an enlarged passage 24 and a smaller passage 25 connected by inwardly extending flange 26.

A feeder tube 27 is positioned in casing 15 and has a flange 28 at its upper end fitted within the bore 24 of plug 22 and resting on inwardly extending flange 26. The details and function of feeder tube 27 will be described more fully hereinafter.

Casing 20 is provided with a check valve assembly 29 positioned between retainer plug 22 and upper sub 11. The check valve assembly allows compressed air or other pneumatic fluid to flow from the string of drilling pipe through the tool to the drill bit but prevents back flow which might carry cuttings into the tool and cause substantial damage. Check valve assembly 29 includes valve member 30 which is positioned against the beveled face 31 of sub 11 to close the orifice or constricted opening 32 opening from the drill string. Valve member 30 has a hollow tubular extension 33 which is guided in a tubular extension 34 on a valve support member 35. Valve support member 35 has a peripheral flange 36 seated on the upper face of retaining plug 22. Valve support member 35 is provided with a plurality of passageways 37 which open from the interior of the upper sub 11 into the upper end portion of feeder tube 27. Passages 37 open into a recess 38 in the lower end of valve support member 35 which fits against the tapered opening 39 opening into the bore 40 of feeder tube 27. Valve support member 35 is provided with a spring 41 positioned in tubular extension 34 and inside the tubular guide portion 33 of valve member 30. Spring 41 urges valve member 30 to close against the beveled valve surface 31 to prevent the flow of air backward through the tool.

The application of compressed air or other pneumatic fluid to the tool through the drill string will cause valve member 30 to move away from beveled valve surface 31 and permit the flow of air through the tool. The force exerted by spring 41 is relatively small and functions only to hold the valve closed when the compressed air is turned off. Valve support member 35 is secured in place with flange 36 tightly held against the end face of retaining member 22. A washer or makeup ring 42 is positioned in a recess 43 in the end of upper sub 11 and abuts the flange 36 of valve support member 35. When the upper sub 11 is assembled into the threaded connection 14, as shown in FIG. 1A, the washer 42 (which is of a suitable elastomeric material) is tightened against flange 36 to hold valve support member 35 tightly in position. The lower end portion of valve support member 35 abuts the flanged end 28 of feeder tube 27 to hold the same tightly against inwardly extending flange 26. An O-ring or other suitable seal 44 of suitable elastomeric material is positioned in a peripheral groove 45 on flange 28 to seal against leakage of compressed air at the inlet and to feeder tube 27. This sealing arrangement prevents the possible build-up of air pressure in the space adjacent the upper end of the feeder tube without the compressed air having gone through the valving which is designed to direct it for movement of the hammer piston.

Feeder tube 27 comprises upper portion 46 and lower portion 47 which are secured together by a threaded connection 48. The feeder tube may be of a single piece, if desired. The upper feeder tube portion 46 is provided with upper and lower peripheral grooves 49 and 50 for retaining oil or other lubricant for lubricating the movement of the hammer piston on the feeder tube. Upper feeder tube portion 46 is provided with a peripheral groove 51 and a plurality of apertures 52 opening into said groove for controlling air flow.

The lower portion 47 of feeder tube 27 has a peripheral shoulder adjacent an upper end portion of reduced diameter which cooperates with the lower end of upper tube portion 46 to define a longitudinally elongated peripheral groove 54. A plurality of apertures 55 open from inside the tube portion 47 into peripheral groove 54.

Still further down the length of feeder tube 27 on the lower tube portion 47 there is provided a peripheral groove 56. A plurality of angularly directed passages 57 open through the wall of the lower tube portion 47 into peripheral groove 56 for directing flow of compressed air as will be subsequently described. The lower tube portion 47 is provided with upper and lower peripheral grooves 58 and 59 which function to retain oil or other lubricant for lubricating the hammer piston which is slidably positioned on the feeder tube. There is provided another peripheral groove 60 at the lower end of the lower feeder tube portion 47 in which there is positioned an elastomeric O-ring for sealing the sliding joint between the feeder tube and the anvil bit member, as will be described hereinafter.

In the middle portion of the feeder tube 27, adjacent the threaded connection between the upper and lower portions 46 and 47, there is provided an air nozzle and venturi arrangement for providing a substantial evacuation of certain areas within the tool during certain stages in the operation thereof. Tubular member 62 has beveled inlet and outlet portions and a restricted central opening 63 providing a venturi for injection of compressed air to provide an evacuation of other portions of the tool as will be hereinafter described. The tubular member 62 is held in place by a press fit assembly against shoulder 47*a*. A hollow tubular nozzle member 64 having an elongated nozzle shaped extension 65 is held in position by a press fit at the end of the lower tube portion 47 adjacent the threaded connection 48. The nozzle shaped extension 65 is positioned to discharge a jet of compressed air through the restricted opening 63 forming the throat of a venturi. The venturi throat and nozzle are positioned adjacent to apertures 55 in the feeder tube and are operable to draw a substantial vacuum through said apertures to evacuate other portions of the tool according to the location of the hammer piston and its valve openings on the feeder tube.

Hammer piston 66 is positioned on feeder tube 27 for longitudinal sliding movement thereon. Hammer piston 66 has a smooth inner bore 67 and a central portion 68 of slightly reduced diameter providing a small clearance relative to the bore of the casing 15. The upper and lower end portions of hammer piston 66 have a relatively close sliding fit in the smooth bore 20 of casing 15. These portions which have a sliding fit in the casing are provided with upper and lower peripheral grooves 69 and 70, respectively, which retain oil or other lubricant for lubricating the sliding movement of the outer surface of hammer piston 66 in the bore 20 of casing 15. As previously described, the inner surface 67 of hammer piston 66 is smooth and has sliding contact along feeder tube 27, aided by lubricant retained by lubricant retaining grooves 48 and 49 and grooves 58 and 59, respectively.

Hammer piston 66 is provided with a plurality of longitudinally extending, somewhat slanted passages 71 which extend from the upper end face 72 of the hammer piston 66 to undercut portion 73 which provides a valving action according to the position of the hammer piston on the feeder tube. There are also provided a plurality of longitudinally extending, somewhat slanted passages 74 which extend from the lower end face 75 of hammer piston 66 to the undercut portion 76 which opens into the sliding bore of the hammer piston and provides a valving function depending upon the position of the hammer piston on the feeder tube.

At the lower end of casing 15, anvil bit member 18 is positioned for longitudinal sliding movement. The upper end surface 76 of anvil bit member 18 provides an anvil surface which is pounded upon by the lower end surface of hammer piston 66. Anvil bit member 18 has a longitudinally extending passage 77 which is slightly enlarged at its upper end as indicated at 78 to receive the lower end of lower feeder tube portion 47 and which has a sliding fit with the sealing gasket or O-ring 60. The lower end of longitudinal passage 77 in anvil member 18 intersects a plurality of passages 79 which extend outward into the lower face of bit member 19 which is preferably provided with a plurality of tungsten carbide or other hardened cutting inserts 80. Anvil-bit member 18 has a plurality of upper peripheral grooves 81 and lower peripheral grooves 82 which retain oil or other lubricant for lubricating the longitudinal movement of the anvil-bit under repeated hammering by hammer piston 66. The bit end 19 of anvil-bit member 18 has a peripheral shoulder 83 which abuts the lower end 84 of casing 15 when the tool is resting with the bit 19 on the ground or on the bottom of a hole being drilled.

A tubular anvil-guide sleeve 85 is positioned closely in the lower end of the bore 20 of casing 15. At the lower end of sleeve 85 there is a very small shoulder 86 which abuts a peripheral shoulder 87 at the top of the threaded connection 17 between driver sub 16 and the lower end of casing 15. The upper end portion of anvil-bit member 18 is slidably positioned in the inner bore of guide sleeve 85. Anvil-bit member 18 has a wide peripheral groove 88 around its upper end having an upper shoulder 89 which engages a stop ring to prevent the anvil-bit from dropping out of the tool when supported off bottom. The bit retainer ring 90 is a split ring having a peripheral groove in which there is positioned an O-ring 91 which secures the pieces of the split ring together. In assembling the apparatus, the anvil-bit member is first inserted through the driver sub 16 and the split ring 90 is assembled on the wide groove 88 and retained in position by O-ring 91. The sub-assembly can be inserted into the lower end of casing 15 with the upper end of the anvil bit member extending into the guide sleeve 85. Driver sub 16 is then screwed into position and abuts the lower edge of split ring 90 to hold the same against the lower end of guide sleeve 85 and to hold the shoulder 86 against the shoulder 87 on casing 15. Split ring 90 is held in this position within an elastic snap ring 92 which fits around the periphery of the assembled split ring 90 and holds guide sleeve 85 in position.

In FIG. 4, the relationship of the anvil-bit member 18 to the driver sub is shown in more detail. It is seen that anvil-bit member 18 is provided with a plurality of splines 93 and splineways 94 which cooperate with mating splineways 95 and splines 96, respectively, in driver sub 16. This system of splines and splineways allows longitudinal sliding movement of anvil-bit member 18 while providing a means to cause the bit to rotate with the tool as it is rotated by the string of drilling pipe to which it is connected.

OPERATION

In FIGS. 1A and 1B, the drilling tool is shown in the position for the parts when it has been assembled on a drilling string and placed against the ground or in a hole to commence drilling. The position of the parts as shown is just prior to pressurizing the tool with compressed air or other pneumatic fluid. When the air pressure is turned on using a suitable compressed air source, preferably about 100–200 psi, the air under pressure will first cause valve 30 to move away from the valve seat surface 31. Air under pressure then passes through the enlarged bore of upper sub 11 and through passages 37 and recess 38 into the bore 40 of feeder tube 27.

The compressed air passes down the bore of feeder tube 27 through nozzle 65 and constricted passage or venturi 63. The compressed air continues to flow continuously on through the bore 77 and outlet passages 79 from anvil-bit member 18. The compressed air which moves at a higher velocity as a result of passing through nozzle 65 moves through the venturi passage 63 at a relatively high speed and produces a venturi effect resulting in evacuation of air from the space around nozzle 65 and the spaces communicating with that space by the adjacent passages. It has been found experimentally a nozzle and venturi structure of the type shown will evacuate a volume equal to the space above the hammer piston 66 and associated passages to about 16–18 in. Hg vacuum. This vacuum is created around the venturi 63 and nozzle 65 and draws air from the passage 71 and from the space above the top of the hammer piston 72.

In the piston shown, the compressed air from the lower part of the bore 40 below the venturi opening 63 may communicate through passages 57, annular groove 56, and passages 74 to the space below the bottom end 75 of hammer piston 66. In this position, using the air pressures suggested, the space below the bottom end 75 of hammer piston 66 is pressurized to the operating air pressure less the pressure drop through the venturi. This would be a pressure slightly less than the inlet pressure of 100–200 psi. At the same time that the lower end 75 of hammer piston 76 is subjected to high pressure, the space at the upper end 72 of hammer piston 66 is evacuated to a vacuum of the order of 16–18 inches. This pressure differential causes hammer piston 66 to rise rapidly along feeder tube 27.

As hammer piston 66 is moved upward under the pressure differential described above, the relationship of the various valve ports and passages is changed. The upward movement of hammer piston 66 will first cause the lower passages 74 to be closed as the opening 76 moves away from annular groove 56 and over the adjacent surface of the feeder tube. At the same time, the movement of hammer piston 66 upward causes the opening 73 from passages 71 to be closed as it moves away from annular grooves 54 and over the upper surface of the upper portion 46 of feeder tube 27.

For a short part of the movement of hammer piston 66, both the upper and lower ports are closed and no air is being supplied to or evacuated from the space on either end of the piston. At the time the ports are all closed, the pressure below the piston is still a relatively high pressure and a vacuum still exists above the upper end of the piston. This pressure differential causes the piston to move upward until it reaches the position shown in FIG. 2.

When the piston reaches the position shown in FIG. 2 the high pressure air communicates through passages 52 and annular groove 51 to the inlet undercuts 73 opening into passages 71. In this position, high pressure air passes into the space between the upper end 72 of hammer piston 76 and the lower surface of retaining member 22. The space above the hammer is then subjected to a high pressure which approaches the inlet pressure of the compressed air.

In this same position of hammer piston 66, the high speed ejection of air through nozzle 65 and venturi 63 causes the space around the nozzle and venturi to be evacuated and to withdraw air through passages 55, annular groove or recess 54, and passages 74 communicating with the space between the lower end 75 of hammer piston 66 and the anvil face 76 and upper surface of retaining sleeve 85. In this position, the feeder tube is still maintained inside the end of anvil-bit member 18 so that the space being evacuated by the nozzle 65 and venturi 63 is a tightly enclosed space. This space is evacuated to a vacuum of about 16–18 inches Hg using compressed air of about 100–200 psi in the operation of the tool.

In the position shown in FIG. 2, the upper end 72 of hammer piston 66 is subjected to compressed air and the lower end is evacuated to provide a substantial pressure differential across the hammer piston. Under this differential of pressure, the hammer piston is driven downward to pound against the upper surface 76 of anvil-bit member 18. As the hammer piston 66 moves downward the various ports first close off the various passages, as was described for the upward stroke of the hammer, leaving the space above the hammer at a high pressure and the space below the hammer at a low pressure. As the hammer piston 66 moves downward to impact against the upper surface 76 of anvil-bit member 18 it reaches the position shown in FIGS. 1A and 1B. In that position, the relationship of the various ports is as described above and compressed air is applied again to the lower face 75 of the hammer piston and the space above the upper end face 72 of the hammer piston is again evacuated. This arrangement of ports and passages for application of compressed air and a vacuum to alternate ends of hammer piston 66 causes the piston to reciprocate upwardly and downwardly along feeder tube 27 to pound repeatedly on the upper face 76 of anvil-bit member 18. While the hammer piston 66 is repeatedly beating upon the upper face 76 of anvil-bit member 18 the drill string (not shown) is rotating the tool and bit 19 is caused to rotate with the tool by means of the relationship between the splines and splineways in anvil-bit member 18 and driver sub 16, as described above.

The pneumatic impact drilling tool, described above, has a number of advantages over the prior art. This tool is substantially simpler in construction, utilizes fewer parts, and is easier to construct. The feeder tube acts as a guide and valving mechanism for the hammer piston and is maintained in continuous communication with the anvil-bit member. This results in the continuous circulation of compressed air through the tool and out through the end of the bit member to remove cuttings from the area being cut by the hammer. The tool has substantially increased strength in view of the elimination of uppercuts and passages in the casing which are found in prior art tools of this type. The use of a separate valve and exhauster tube is eliminated in this construction as a result of the continuous communication of the feeder tube with the anvil-bit member. The air nozzle and venturi arrangement used in this construction results in an increased pressure applied to the down stroke and provides a negative pressure or vacuum to accelerate the exhaust of air from the casing and to assist by providing an increased pressure differential across the hammer piston.

This improved construction utilizes standard components with a minimum amount of change. Most of the components of the pneumatic impact drilling tool of U.S. Pat. No. 3964551 can be used in this invention with only slight changes made in the feeder tube. It should also be noted that the particular check valve used in the inlet to this tool is not a critical feature of the invention. The check valve shown is a preferred one from a commercial standpoint but other check valves of the type shown in Bassinger U.S. Pat. No. 3964551 and other pneumatic impact drilling tools may be used.

While this invention has been fully and completely described with special emphasis upon a single preferred embodiment, it should be understood that the inventive concept is limited only by the appended claims.

I claim:

1. An impact drilling tool for connection in a string of drilling pipe comprising an upper sub for connection to said drilling pipe, a casing with an upper end connected to said upper sub, an anvil member slidably positioned in the lower end of said casing and having a bit member on its lower end extending outside said casing, a hammer piston positioned in said casing above said anvil member for reciprocal movement longitudinally of said casing to strike said anvil member repeatedly, a feeder tube for feeding compressed pneumatic fluid from said drilling pipe extending longitudinally of said casing through said hammer piston and into the upper end of said anvil member, a venturi member positioned in said feeder tube intermediate the ends thereof and within said hammer piston for producing a partial vacuum adjacent thereto upon passage of pneumatic fluid therethrough at a high velocity, a passageway extending through the wall of said feeder tube from a point adjacent said venturi member to a point within said hammer member, and a plurality of passages, including said last-named passageway, and valve openings cooperable therewith in said feeder tube and said hammer piston to apply compressed pneumatic fluid to one end of said hammer piston and said vacuum to the other end thereof when in one position and to apply vacuum to said one end and compressed pneumatic fluid to said other end when said hammer piston is in another position, for effecting reciprocal movement thereof substantially all of the spent penumatic fluid exhausting from said tool through said passageway.

2. The drilling tool according to claim 1 in which said anvil member is guided for reciprocal movement on said feeder tube and sealed against leakage of compressed pneumatic fluid between the mating surfaces thereof.

3. A drilling tool according to claim 1 in which said anvil member is guided for reciprocal movement on said feeder tube and a sealing ring is positioned between said feeder tube and said anvil member to prevent leakage of pneumatic fluid.

4. A drilling tool according to claim 1 in which said hammer piston has a bore which slides on said feeder tube and has at least one passageway extending from one end longitudinally and inwardly to said bore and another passageway extending from the other end longitudinally and inwardly to said bore, said feeder tube having longitudinally spaced openings for discharge of compressed pneumatic fluid and an opening adjacent said venturi for application of said vacuum, and said openings in said hammer piston and said feeder tube being spaced and positioned to cooperate to apply compressed pneumatic fluid and vacuum, respectively, to alternate ends of said hammer piston.

5. A drilling tool according to claim 1 in which said hammer piston has a bore which slides on said feeder tube and has at least one passageway extending from one end longitudinally and inwardly to said bore and another passageway extending from the other end longitudinally and inwardly to said bore, said feeder tube having longitudinally spaced openings for discharge of pneumatic fluid and a wide peripheral groove with an opening adjacent said venturi for application of said vacuum, and said openings in said hammer piston and said openings and said wide groove in said feeder tube being spaced and positioned to cooperate to apply compressed pneumatic fluid and vacuum, respectively, to alternate ends of said hammer piston.

6. A drilling tool according to claim 1 in which said vacuum-producing venturi includes a tubular member with a venturi opening and an air-nozzle member positioned to discharge compressed air at high velocity into said venturi opening to evacuate the space adjacent thereto.

7. A drilling tool according to claim 1 in which said vacuum-producing venturi includes a tubular member with a venturi opening and an air-nozzle member positioned to discharge compressed air at a high velocity into said venturi opening to evacuate the space adjacent thereto, said hammer piston has a bore which slides on said feeder tube and has at least one passageway extending from one end longitudinally and inwardly to said bore and another passageway extending from the other end longitudinally and inwardly to said bore, said feeder tube having longitudinally spaced openings for discharge of compressed air and a wide peripheral groove with an opening adjacent said venturi for application of said vacuum, and said openings in said hammer piston and said openings and wide groove on said feeder tube being spaced and positioned to cooperate to apply compressed air and vacuum, respectively, to alternate ends of said hammer piston.

8. A drilling tool according to claim 1 which includes a check valve positioned between said feeder tube and said upper sub to prevent back flow of compressed pneumatic fluid through said sub.

9. A gas powered impact tool which comprises a housing adapted to be connected to a source of compressed gas, an anvil slidably positioned in and extending out of the lower end of said housing, a hammer piston mounted for longitudinally sliding reciprocal movement to beat upon said anvil, means for conducting compressed gas inside said hammer piston, means for producing a partial vacuum inside said hammer piston comprising a member having a venturi opening and a compressed gas nozzle member positioned to introduce high velocity gas into said venturi opening, means forming a hermetic enclosure between the upper end of said hammer piston and the upper end of said housing, means forming a hermetic enclosure between the lower end of said hammer piston and said housing and the upper end of said anvil, valve means for directing compressed gas alternately to opposite ends of said hammer piston into said hermetically sealed enclosures, and valve means for directing said vacuum alternately to opposite ends of said hammer piston to the hermetically sealed enclosure opposite the enclosure supplied with compressed gas to effect reciprocal movement of said hammer piston substantially all of the spent penumatic fluid exhausting from said tool through said lastnamed valve means.

10. An impact tool according to claim 9 in which said compressed gas conducting means is a longitudinally extending feeder tube extending through said hammer piston and into said anvil, and said first named and second named valve means comprise passages and openings in said feeder tube and in said hammer piston positioned to direct compressed gas and vacuum to the respective ends of said hammer piston.

* * * * *